US005514190A

United States Patent [19]

Cunningham et al.

[11] Patent Number: 5,514,190

[45] Date of Patent: May 7, 1996

[54] FUEL COMPOSITIONS AND ADDITIVES THEREFOR

[75] Inventors: Lawrence J. Cunningham, Mechanicsville; Thomas L. Zahalka, Richmond, both of Va.

[73] Assignee: Ethyl Corporation, Richmond, Va.

[21] Appl. No.: 351,926

[22] Filed: Dec. 8, 1994

[51] Int. Cl.[6] ..... C10L 1/22

[52] U.S. Cl. ..... 44/415; 44/387

[58] Field of Search ..... 44/415, 387

[56] References Cited

U.S. PATENT DOCUMENTS

| | | | |
|---|---|---|---|
| 4,116,644 | 9/1978 | Jackisch et al. | 44/415 |
| 4,191,537 | 3/1980 | Lewis et al. | 44/415 |
| 4,231,759 | 11/1980 | Udelhofen et al. | 44/415 |
| 4,944,770 | 7/1990 | Sung | 44/415 |
| 5,387,266 | 2/1995 | Loper | 44/415 |
| 5,413,614 | 5/1995 | Cherpeck | 44/415 |

*Primary Examiner*—Jacqueline V. Howard

*Attorney, Agent, or Firm*—Dennis H. Rainear; William H. Thrower

[57] ABSTRACT

A highly effective fuel additive composition for control of intake valve deposits is described. It comprises (a) a gasoline-soluble Mannich reaction product of (i) a high molecular weight alkyl-substituted phenol, (ii) amine, and (iii) aldehyde; (b) a gasoline-soluble poly(oxyalkylene) carbamate; and (c) a gasoline-soluble poly(oxyalkylene) alcohol, glycol or polyol, or mono or diether thereof. Fuel compositions and methods of controlling engine deposits are also described.

35 Claims, No Drawings

FUEL COMPOSITIONS AND ADDITIVES THEREFOR

TECHNICAL FIELD

This invention relates to novel fuel additive compositions that can be used for control of deposits in spark-ignition internal combustion engines.

BACKGROUND

Over the years considerable work has been devoted to additives for controlling (preventing or reducing) deposit formation in the fuel induction systems of spark-ignition internal combustion engines. In particular, additives that can effectively control intake valve deposits represent the focal point of considerable research activities in the field and despite these efforts, further improvements are desired. Among relatively recent efforts along these lines is U.S. Pat. No. 5,242,469 and published Canadian patent application 2,089,833.

The additive systems described in U.S. Pat. No. 5,242,469 comprise an ester and at least one dispersant component chosen from certain monosuccinimides, bis(succinimides), polyolefin polyamines, and benzylamine derivatives. The benzylamine derivatives appear to be Mannich-type detergents*. These additive combinations may further contain a polyoxyalkylene glycol or derivative thereof having a molecular weight of 500–5000, preferably 1000–3000. Also, a specified type of lubricating oil fraction may be included in the additive mixture. The polyoxyalkylene glycol derivatives referred to in the text of the patent include the ethers, esters and ether aminoacid esters of the polyoxyalkylene glycol.

*According to the patent the hydroxybenzyl amine derivatives are made by alkylating a hydroxybenzyl amine which in turn presumably would be formed by a Mannich reaction among phenol, formaldehyde and polyamine. The resultant product should be similar, if not identical, to a product made in the more usual sequence of alkylating the phenol and then conducting the Mannich reaction with the resultant alkylated phenol, formaldehyde and a polyamine.

Canadian patent application 2,089,833 bearing a publication date of Aug. 21, 1993 describes a similar additive system. In particular, the gasoline is to contain (a) from 75 to 450 ppmw of a specified group of Mannich base detergents in combination with (b) from 75 to 175 ppmw of an oil-soluble poly(oxyalkylene) alcohol, glycol or polyol or mono or di ether thereof, wherein the weight ratio of (a) to (b) in the mixture is at least 0.43.

THE INVENTION

It has now been discovered that a combination of three oil-soluble fuel additive components has the capability of providing excellent performance in the control of engine deposits in spark-ignition internal combustion engines.

Accordingly, in one of its embodiments, this invention provides, a fuel-soluble additive composition which comprises a) a Mannich reaction product of (i) a high molecular weight alkyl-substituted phenol, (ii) amine, and (iii) aldehyde;

b) a poly(oxyalkylene) carbamate; and c) a poly(oxyalkylene) alcohol, glycol or polyol, or mono or diether thereof.

Preferably, the composition will additionally contain a minor amount of one or more liquid hydrocarbons which, whether a single hydrocarbon or a mixture of different hydrocarbons, has a viscosity that is not substantially in excess of the viscosity of the poly(oxyalkylene) component c). The term "not substantially in excess of" means that, independently, the kinematic viscosities of the hydrocarbon(s) at 40° C. and at 100° C. can be lower, or equal to or as much as about 25% higher than the kinematic viscosities of the poly(oxyalkylene) component c) at the corresponding temperatures. For example, the viscosity of the single hydrocarbon (if only a single hydrocarbon is used) or the collective viscosity of all of the hydrocarbons used (where a mixture of different hydrocarbons is used, such as a low boiling aromatic hydrocarbon solvent plus a more viscous poly-α-olefin carrier) in centistokes (cSt) can be, say, 20% higher than the viscosity of component c) in cSt at 40° C. but, say, lower in cSt than the viscosity of component c) in cSt at 100° C. This hydrocarbon component can be in whole or in part a hydrocarbon diluent or solvent associated with either or both of components a) and b) . Likewise it can be in whole or in part a separately added hydrocarbon diluent formulated into the concentrate at any appropriate stage during the production of the concentrate. Similarly it can be a combination of (i) a hydrocarbon diluent or solvent associated with either or both of components a) and b) and (ii) a separately added hydrocarbon diluent formulated into the concentrate at any appropriate stage during the production of the concentrate.

In another of its embodiments, this invention provides a fuel composition which comprises gasoline containing a minor deposit controlling amount of a) a Mannich reaction product of (i) a high molecular weight alkyl-substituted phenol, (ii) amine, and (iii) aldehyde; and b) a poly(oxylalkylene) carbamate; and c) a poly(oxyalkylene) alcohol, glycol or polyol, or mono or diether thereof.

The fuel composition may also contain one or more of the above-referred to liquid hydrocarbons which were present in the additive concentrate, i.e., the single hydrocarbon or mixture of different hydrocarbons having a viscosity not substantially in excess of the viscosity of poly(oxyalkylene) component c).

Other components which may be included in the additive concentrates and fuel compositions of this invention are referred to hereinafter.

In preferred embodiments component c) comprises one or more poly(oxyalkylene) alcohols, glycols or polyols or mono or diethers thereof, with the proviso that such compounds have in their undiluted state a viscosity of at least about 70 centistokes (cSt) at 40° C. and at least about 13 cSt at 100° C.

Typically the proportions of a) to b) to c) in the compositions of this invention are such that per part by weight of c) there are from about 0.2 to about 5 parts by weight of a) , and from about 0.2 to about 5 parts by weight of b). Preferably per part by weight of c) there are from about 0.5 to about 3 parts by weight of a), and more preferably from about 0.7 to about 2 parts by weight of a), and from about 0.5 to about 3 parts by weight of b), and more preferably from about 0.7 to about 2 parts by weight of b). It is to be noted that the foregoing proportions are based on the weights of both a) and b) on an "active ingredient basis". By this is meant that typically component a) is supplied in admixture on a weight basis with a minor amount of a diluent and a minor amount of unreacted polyolefin used in making the alkylated phenol from which the Mannich detergent is produced. Likewise, component b) as received may contain one or more solvents, diluents or carriers. Thus the foregoing proportions of a) and b) to c) are based on the content of Mannich base detergent in component a) excluding the weight of any diluent or solvent and any unreacted polyolefin which may be associated therewith in the form in which it is supplied, and the actual content of poly(oxyalkylene) carbamate in component b) if received in a diluted form. Component c) will normally be supplied in undiluted form, and in such case its weight can be used directly in calculating the ratio of a) to b) to c). But if the polyoxyalkylene alcohol, glycol or polyol, or mono or diether thereof is in diluted form when being blended with a) and/or b), the weight of c) should be based on the weight of the polyoxyalkylene alcohol, glycol or polyol, or mono or diether thereof, and should likewise exclude the weight of any solvent or diluent associated therewith.

It will be understood that any such ancillary solvent or diluent, whether hydrocarbon or otherwise, must not adversely affect the intake valve deposit control performance of the above additive composition in any material way. Thus as long as they do not exert such adverse effect, ethers, esters, alcohols, or other inert solvents or diluents may be present in the additive composition. Preferably, however, the ancillary diluents or solvents (which most preferably are hydrocarbons) collectively have viscosities at 40° C. and 100° C. that are not substantially in excess of the viscosity of the polyoxyalkylene compound. As noted above, these collective viscosities (in cSt) are preferably not more than approximately 25 percent higher than the corresponding 40° C. and 100° C. viscosities of the polyoxyalkylene compound being used. Not only does this ensure that the intake valve deposit control effectiveness of the composition will not be adversely affected in any material way, but it keeps the cost of the additive composition to a minimum.

In another embodiment, this invention provides a method for reducing intake valve deposits in gasoline engines. The method comprises fueling said engines with a fuel composition comprising (a) a major amount of hydrocarbonaceous fuel in the gasoline boiling range and (b) a minor intake valve deposit controlling amount of a) a Mannich reaction product of (i) a high molecular weight alkyl-substituted phenol, (ii) amine, and (iii) aldehyde;

b) a poly(oxyalkylene) carbamate; and c) a poly(oxyalkylene) alcohol, glycol or polyol, or mono or diether thereof.

Here again, component c) preferably has in its undiluted state a viscosity of at least about 70 centistokes (cSt) at 40° C. and at least about 13 cSt at 100° C. Also, the fuel may contain one or more of the above-referred to liquid hydrocarbons which were present in the additive concentrate, i.e., the single hydrocarbon or mixture of different hydrocarbons having a viscosity not substantially in excess of the viscosity of poly(oxyalkylene) component c). Also, the fuel may additionally contain one or more other suitable components such as are referred to hereinafter.

Component a)

As noted above, the Mannich reaction product component of this invention typically contains a significant portion of hydrocarbonaceous ingredients which are inactive in the sense that they do not possess polarity or surface activity and therefore do not serve as detergents. For example, subsequent to the manufacture of the Mannich reaction product, hydrocarbon solvent is typically added to dilute the product to facilitate handling and blending. Solvent is generally present in the product in a minor amount, e.g., less than 20 wt. %, of the recovered reaction product composition. Typically, however, the solvent is present in the diluted reaction product in an amount ranging from about 40 to about 50 wt. %. Thus the Mannich product as received typically contains about 40 to about 55 wt. % of the active Mannich base ingredient, the balance being solvent or diluent, and unreacted materials from the synthesis steps, such as polyolefin polymer. A generally used dilution solvent is a mixture of aromatic hydrocarbons such as o-, p-, and m-xylene, mesitylene, and higher boiling aromatics such as Aromatic 150 (commercially available from Chemtech).

The Mannich reaction products of this invention are obtained by condensing an alkyl-substituted hydroxyaromatic compound whose alkyl-substituent has a number average molecular weight of from about 600 to about 14,000, preferably alkylphenol whose alkyl substituent is derived from 1-monoolefin polymer having a number average molecular weight of from about 600 to about 3000, preferably about 750 to about 1200, more preferably about 800 to about 1200, and most preferably about 800 to about 950; an amine having at least one >NH group, preferably an alkylene polyamine of the formula $$H_2N—(A—NH—)_xH$$

where A is a divalent alkylene radical having 1 to 10 carbon atoms and x is an integer from 1 to 10; and an aldehyde, preferably formaldehyde or a formaldehyde precursor, in the presence of a solvent.

High molecular weight Mannich reaction products useful as additives in the fuel additive compositions of this invention are preferably prepared according to conventional methods employed for the preparation of Mannich condensation products, using the above-named reactants in the respective molar ratios of (i) high molecular weight alkyl-substituted hydroxyaromatic compound, (ii) amine, and (iii) aldehyde of approximately 1.0:0.1–10:1–10. Usually the reactants are charged in proportions such that there are an excess of the aldehyde and an excess of a polyamine relative to the hydroxyaromatic compound such as an alkylphenol which thereby becomes the limiting reactant. For example it is common to charge about 1 to 3 moles of polyamine and about 1.2 to 4 moles of aldehyde per mole of (i). A suitable condensation procedure involves adding at a temperature of from room temperature to about 95° C., the formaldehyde reagent (e.g., Formalin) to a mixture of amine and alkyl-substituted hydroxyaromatic compounds alone or in an easily removed organic solvent, such as benzene, xylene, or toluene or in solvent-refined neutral oil and then heating the reaction mixture at an elevated temperature (120°–175° C.) while preferably blowing with an inert stripping gas, such as nitrogen, carbon dioxide, etc., until dehydration is complete. The reaction product so obtained is finished by filtration and dilution with solvent as desired.

Preferred Mannich reaction product additives employed in this invention are derived from high molecular weight Mannich condensation products, formed by reacting an alkylphenol, an ethylene polyamine, and a formaldehyde affording reactants in the respective molar ratio of 1.0:0.5–2.0:1.0–3.0, wherein the alkyl group of the alkylphenol has a number average molecular weight (Mn) of from about 600 to about 3,000, and more preferably from about 750 to about 1,200.

Representative of the high molecular weight alkyl-substituted hydroxyaromatic compounds are polypropylphenol (formed by alkylating phenol with polypropylene), polybutylphenol (formed by alkylating phenol with polybutenes or polyisobutylene), and other similar long-chain alkylphenols.

Polypropylphenol is the most preferred reactant. Polyalkylphenols may be obtained by the alkylation, in the presence of an alkylating catalyst such as $BF_3$, of phenol with high molecular weight polypropylene, polybutylene and other polyalkylene compounds to give alkyl substituents on the benzene ring of phenol having a number average molecular weight (Mn) of from about 600 to about 14,000.

The alkyl substituents on the hydroxyaromatic compounds may be derived from high molecular weight polypropylenes, polybutenes, and other polymers of mono-olefins, principally 1-mono-olefins. Also useful are copolymers of mono-olefins with monomers copolymerizable therewith wherein the copolymer molecule contains at least 90% by weight, of mono-olefin units. Specific examples are copolymers of butenes (butene-1, butene-2, and isobutylene) with monomers copolymerizable therewith wherein the copolymer molecule contains at least 90% by weight of propylene and butene units, respectively. The monomers copolymerizable with propylene or butenes include monomers containing a small proportion of unreactive polar groups such as chloro, bromo, keto, ether, aldehyde, which do appreciably lower the oil-solubility of the polymer. The comonomers polymerized with propylene or such butenes may be aliphatic and can also contain non-aliphatic groups, e.g., styrene, methylstyrene, p-dimethylstyrene, divinyl benzene and the like. From the foregoing limitation placed on the monomer copolymerized with propylene or the butenes, it is clear that the resulting polymers and copolymers are substantially aliphatic hydrocarbon polymers. Thus, the resulting alkylated phenols contain substantially alkyl hydrocarbon substituents having a number average molecular weight (Mn) of from about 600 to about 14,000.

In addition to the foregoing high molecular weight hydroxyaromatic compounds, other phenolic compounds which may be used include, high molecular weight alkyl-substituted derivatives of resorcinol, hydroquinone, cresol, catechol, xylenol, hydroxydiphenyl, benzylphenol, phenethylphenol, naphthol, tolylnaphthol, among others. Preferred for the preparation of such preferred Mannich condensation products are the polyalkylphenol reactants, e.g., polypropylphenol and polybutylphenol whose alkyl group has a number average molecular weight of 600–3000, the more preferred alkyl groups having a number average molecular weight of 740–1200, while the most preferred type of alkyl groups is a polypropyl group having a number average molecular weight of about 900–950.

The preferred configuration of the alkyl-substituted hydroxyaromatic compound is that of a para-substituted mono-alkylphenol. However, any alkylphenol readily reactive in the Mannich condensation reaction may be employed. Thus, Mannich products made from alkylphenols having only one ring alkyl substituent, or two ring alkyl substituents are suitable for use in this invention.

Representative amine reactants are alkylene polyamines, principally polyethylene polyamines. Other representative organic compounds containing at least one HN< group suitable for use in the preparation of the Mannich reaction products are well known and include the mono and di-amino alkanes and their substituted analogs, e.g., ethylamine, dimethylamine, dimethylaminopropyl amine, and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

The alkylene polyamine reactants which are useful with this invention include polyamines which are linear, branched, or cyclic; or a mixture of linear, branched and/or cyclic polyamines wherein each alkylene group contains from about 1 to about 10 carbon atoms. A preferred polyamine is a polyamine containing from 2 to 10 nitrogen atoms per molecule or a mixture of polyamines containing an average of from about 2 to about 10 nitrogen atoms per molecule such as ethylenediamine, diethylene triamine, triethylene tetramine, tetraethylene pentamine, pentaethylene hexamine, hexaethylene heptamine, heptaethylene octamine, octaethylene nonamine, nonaethylene decamine, and mixtures of such amines. Corresponding propylene polyamines such as propylene diamine, and dipropylene triamine, tripropylene tetramine, tetrapropylene pentamine, pentapropylene hexamine are also suitable reactants. A particularly preferred polyamine is a polyamine or mixture of polyamines having from about 3 to 7 nitrogen atoms with diethylene triamine or a combination or mixture of ethylene polyamines whose physical and chemical properties approximate that of diethylene triamine being the most preferred. In selecting an appropriate polyamine, consideration should be given to the compatibility of the resulting detergent/dispersant with the gasoline fuel mixture with which it is mixed.

Ordinarily the most highly preferred polyamine, diethylene triamine, will comprise a commercially available mixture having the general overall physical and/or chemical composition approximating that of pure diethylene triamine but which can contain minor amounts of branched-chain and cyclic species as well as some other linear polyethylene polyamines such as triethylene tetramine and tetraethylene pentamine. For best results, such mixtures should contain at least 50% and preferably at least 70% by weight of the linear polyethylene polyamines of which at least 50 mole % is diethylene triamine.

The alkylene polyamines are usually obtained by the reaction of ammonia and dihaloalkanes, such as dichloroalkanes. Thus, the alkylene polyamines are obtained from the reaction of 2 to 11 moles of ammonia with 1 to 10 moles of dichloroalkanes having 2 to 6 carbon atoms and chlorine atoms on different carbon atoms.

Representative aldehydes for use in the preparation of high molecular weight Mannich products include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

Important considerations insofar as the present invention is concerned, are to insure that the alkylphenol having an alkyl substituent with the desired number average molecular weight be reacted with the preferred polyethylene polyamine and aldehyde compounds and that the reactants be employed in proportions such that the resultant Mannich reaction product contains the requisite proportions of the chemically combined reactants, all as specified herein. When utilizing this combination of features, the resultant compositions of this invention not only possess exceptional effectiveness in controlling or reducing the amount of induction system deposits formed during engine operation but which permit adequate demulsification performance.

Component b)

The carbamates useful in the practice of this invention are characterized by having a polyoxyalkylene moiety linked to an amine-containing moiety by a carbamate linkage, i.e.,

—O—(CO)—N<

Among such compounds are the following:

A. A poly(oxyalkylene)carbamate having at least one $C_1$–$C_{30}$ hydrocarbyloxy-terminated polyoxyalkylene chain of 2 to 5 carbon oxyalkylene units bonded through an oxycarbonyl group to a nitrogen atom of a polyamine. In these carbamates, the polyamine preferably has from 2 to 10 amino nitrogen atoms and from 2 to 40 carbon atoms. The molecular weight of such carbamates is typically in the range of 500 to 10,000, and preferably in the range of 800 to 5000. Compounds of this type and a process for producing them are described in U.S. Pat. No. 4,160,648. Compounds of this type wherein the polyamine is ethylene diamine and in which the poly(oxyalkylene) chain contains sufficient oxyalkylene units other than ethyleneoxy units to render the compounds soluble in gasoline and a process for producing these compounds are described in U.S. Pat. No. 4,236,020.

B. A hydrocarbylpoly(oxyalkylene)aminocarbamate of molecular weight from about 600 to 10,000, and having at least one basic nitrogen atom. The hydrocarbylpoly(oxyalkylene) moiety is preferably composed of oxyalkylene units selected from 2 to 5 carbon oxyalkylene units of which at least a sufficient number are branched oxyalkylene units to render the carbamate fuel soluble. The hydrocarbyl group of these carbamates preferably contains from 1 to 30 carbon atoms. Compounds of this type and a process for producing them are described in U.S. Pat. No. 4,191,537. Compounds of this type wherein the amine moiety is derived from an ethylene diamine having up to 24 carbon atoms, and wherein preferably the diamine is substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C), and a process for producing these compounds are described in U.S. Pat. No. 4,288,612. The molecular weight of these compounds is preferably in the range of about 1200 to 5000, the oxyalkylene units are preferably selected from $C_3$–$C_4$ oxyalkylene units (most preferably oxybutylene units), and the hydrocarbyl group of the hydrocarbylpoly (oxyalkylene) aminocarbamate is preferably an alkyl group (such as butyl) or an alkylphenyl group of from 7 to 24 carbon atoms.

C. A hydrocarbylpoly(oxyalkylene) ureylene carbamate of molecular weight from about 600 to 10,000, and having at least one basic nitrogen atom. The hydrocarbylpoly (oxyalkylene) moiety is preferably composed of oxyalkylene units selected from 2 to 5 carbon oxyalkylene units of which at least a sufficient number are branched chain oxyalkylene units to render the carbamate fuel soluble. The hydrocarbyl group of these carbamates preferably contains from 1 to 30 carbon atoms. Compounds of this type and a process for producing them are described in U.S. Pat. No. 4,234,321.

D. A hydrocarbyl-terminated poly(oxyalkylene)aminohydrocarbyloxyhydrocarbyl carbamate, also referred to as a polyetheraminoether carbamate as described and depicted in U.S. Pat. Nos. 4,521,610 and 4,695,291.

E. An alkylphenyl poly (oxyalkylene) aminocarbamate having at least one basic nitrogen and an average molecular weight of about 800 to 6000 and wherein the alkyl group of the alkylphenyl poly(oxyalkylene) aminocarbamate contains at least 40 carbon atoms and the poly(oxyalkylene) polymer is derived from $C_2$ to $C_5$ oxyalkylene units. If the polymer is a homopolymer of oxyethylene, the polymer should not contain more than 25 oxyethylene units. Compounds of this type and a process for producing them are described in U.S. Pat. No. 4,933,485.

F. A liquid alkylphenyl poly(oxypropylene) aminocarbamate which does not form a wax when cooled to –40° C. in a 50 weight percent solution with toluene, wherein the aminocarbamate has at least one basic nitrogen and an average molecular weight of about 600 to 6000 and wherein the alkyl group of the alkylphenyl poly(oxypropylene) aminocarbamate is a substantially straight-chain alkyl group of from about 25 to 50 carbon atoms. Preferably, the substantially straight-chain alkyl group is attached to the phenol ring at least 6 carbon atoms from the terminus of the longest chain of the alkyl group. Compounds of this type and a process for producing them are described in U.S. Pat. No. 5,322,529.

Component c)

The polyoxyalkylene compounds suitable for use in the practice of this invention comprise one or more poly(oxyalkylene) alcohols, glycols or polyols or mono or diethers thereof, with the proviso that such compounds have in their undiluted state a viscosity of at least about 50 and preferably at least about 70 centistokes (cSt) at 40° C. and at least about 7 and preferably at least about 13 cSt at 100° C. Such compounds can be represented by the following formula $$R_1—(—R_2O—)_n—R_3 \quad (I)$$

wherein $R_1$ is a hydrogen atom, or hydroxy, alkyl, cycloalkyl, aryl, alkaryl, aralkyl, alkoxy, cycloalkoxy, or amino group having in the range of 1–200 carbon atoms, $R_2$ is an alkylene group having 2–10 carbon atoms, $R_3$ is a hydrogen atom or alkyl, cycloalkyl, aryl, alkaryl, aralkyl, or hydrocarbylamino group having 1–200 carbon atoms, and n is an integer in the range from 1 to 500 (and preferably in the range of from 3 to 120) representing the number of repeating alkyleneoxy groups, all with the proviso that the product in its undiluted state is a liquid having a viscosity of at least about 50 and preferably of at least about 70 centistokes (cSt) at 40° C. and at least about 7 and preferably at least about 13 cSt at 100° C. Polyoxyalkylene compounds with a viscosity of at least about 50 cSt at 40° C. and at least about 13 cSt at 100° C. or a viscosity of at least about 70 cSt at 40° C. and at least about 7 cSt at 100° C. are also suitable for use.

Preferred polyoxyalkylene compounds are polyoxyalkylene glycol compounds and monoether derivatives thereof that satisfy the above viscosity requirements and that are comprised of repeating units formed by reacting an alcohol or polyalcohol with an alkylene oxide, such as propylene oxide and/or butylene oxide with or without use of ethylene oxide, and especially products in which at least 80 mole % of the oxyalkylene groups in the molecule are derived from 1,2-propylene oxide. Details concerning preparation of such polyoxyalkylene compounds are referred to, for example, in Kirk-Othmer, *Encyclopedia of Chemical Technology,* Third Edition, Volume 18, pages 633–645 (Copyright 1982 by John Wiley and Sons), and in references cited therein, the foregoing excerpt of the Kirk-Othmer encyclopedia and the references cited therein being incorporated herein in toto by reference. U.S. Pat. Nos. 2,425,755; 2,425,845; 2,448,664; and 2,457,139 also describe such procedures, and are also incorporated herein by reference as if fully set forth herein.

Preferred poly(oxyalkylene) compounds can be represented by the formula $$R_4O—(R_5O)_p—R_6 \quad (II)$$

wherein $R_4$ is a hydrogen atom, or a hydrocarbyl group having up to 18 carbon atoms, and more preferably an alkyl group having up to 10–15 carbon atoms; $R_5$ is an alkylene group which is preferably an ethylene (i.e., dimethylene)

group, a propylene (i.e., methyldimethylene) group, or a butylene (i.e., ethyldimethylene) group; $R_6$ is a hydrogen atom, or a hydrocarbyl group having up to 18 carbon atoms, and more preferably an alkyl group having up to 10–12 carbon atoms; and p is a integer that yields a product having the viscosity parameters given above. Commercially available products are often composed of mixtures in which the individual species of the mixture have different numerical values for p, and thus in the case of such mixtures the value of p for the overall product represents an average value. The alkylene groups $R_5$ can all be the same or they can be different and if different, can be arranged either randomly or in prearranged blocks or sequences. Particularly preferred are the polyoxyalkylene alcohols and glycols in which from 70 to 100% and especially 80 to 100% of the alkylene groups are propylene groups (methyldimethylene groups) derived from use 1,2-propylene oxide in the alkoxylation reaction usually employed in the production of such products. In these particularly preferred polyoxyalkylene alcohols, glycols and diethers, if less than 100% of the alkylene groups are propylene groups, the remainder are either ethylene or butylene groups, or both, proportioned to yield a liquid product having the requisite viscosity properties specified above. Monools derived by propoxylation of alkanols ($R_4$ in Formula (II) is alkyl, $R_5$ is methyldimethylene groups, $R_6$ is a hydrogen atom, and p is as defined above) are most preferred. Such compounds can also be thought of as monoethers of polyoxyalkylene glycols.

Other poly(oxyalkylene) glycols and ethers which may be employed can be represented by the formula $$R_7O—(—R_8O—)_q—R_9—(—OR_{10}—)_r—OR_{11} \quad \text{(III)}$$

wherein $R_7$ and $R_{11}$ can be the same or different and each is independently a hydrogen atom or a hydrocarbyl group, preferably an alkyl group of up to 18 carbon atoms, and more preferably of up to 10–12 carbon atoms; $R_8$ and $R_{10}$ can be the same or different and are alkylene groups which can be ethylene groups (i.e., dimethylene groups), but which preferably comprise or consist of propylene (i.e., methyldimethylene) groups, and/or butylene (i.e., ethyldimethylene) groups; $R_9$ is an divalent hydrocarbylene group derived from the initiator, and thus can be a group such as a phenylene group or an alkylene group which is preferably an ethylene (i.e., dimethylene) group, a propylene (i.e., methyldimethylene) group, or a butylene (i.e., ethyldimethylene) group, and q and r are independently integers that yield a product having the viscosity parameters given above. Commercially available products are often composed of mixtures in which the individual species of the mixture have different numerical values for q and different numerical values for r, and thus in the case of such mixtures the values of q and r for the overall product represent average values. As noted, the alkylene groups can all be the same or they can be different and if different, can be arranged either randomly or in blocks or sequences.

The most preferred polyoxyalkylene glycol derivative compound useful in the compositions and methods of this invention is known commercially as EMKAROX AF22 available from ICI Chemicals and Polymers Ltd. This compound has a pour point of about –42° C., a density of about 0.980 g/ml at 20° C., an open cup flash point of about 230° C., a viscosity of about 90 cSt (typically in the range of about 87 to about 98 cSt) at 40° C. and about 17 cSt (typically in the range of about 15 to about 19 cSt) at 100° C., an average molecular weight of about 1700, a viscosity index of about 200, and a volatility as determined by the Volatility Determination Method described hereinafter of less than about 50%. The number average molecular weight of the polyoxyalkylene compounds of this invention is preferably in the range of from about 200 to about 5000, more preferably from about 500 to about 3,000, and most preferably from about 1,500 to about 2,000.

Component d)

Hydrocarbon diluents, solvents or carriers which need not be used, but which can be and typically are present in the compositions of this invention can be of various types.

One type has been referred to above, namely hydrocarbon solvent or diluent, and unreacted hydrocarbonaceous materials from the synthesis steps, such as polyolefin polymer associated with component a) as received, and/or hydrocarbon solvent or diluent associated with component b) as received.

Another type referred to above are aromatic hydrocarbons of relatively low viscosity and boiling temperatures which preferably are employed in the formulation of the additive concentrates of this invention. A wide variety of liquid hydrocarbon solvents can be used for this purpose, and these typically consist of or at least are comprised of a major proportion (i.e., over 50% by weight) of one or more mononuclear aromatic hydrocarbons such as liquid mixtures of alkyl-substituted benzenes. Particularly useful are mixtures of o-, p-, and m-xylenes and mesitylene and higher boiling aromatics such as Aromatic 150 which is available from Chemtech. One preferred type of aromatic hydrocarbon component has a boiling point or a final boiling point no higher than about 240° C. Also preferred are mixtures of aromatic hydrocarbon that boil in the range of about 160° to about 300° C. and have a viscosity in the range of about 1.4 to about 2.0 cSt at 25° C. Such preferred mixtures may contain small amounts (e.g., up to about 5 volume %) of non-aromatic hydrocarbons, but most preferably are substantially entirely composed of aromatic hydrocarbons.

Another optional hydrocarbon component of the compositions of this invention is poly-α-olefin oligomer (PAO). These oligomers can be fully hydrogenated (hydrotreated), partially hydrogenated, or unhydrogenated poly-α-olefins. Typically, these materials are primarily trimers, tetramers and pentamers of alpha-olefin monomers containing from 6 to 12, generally 8 to 12 and most preferably about 10 carbon atoms. Their synthesis is outlined in *Hydrocarbon Processing*, February 1982, page 75 et seq. and essentially comprises catalytic oligomerization of short chain linear alpha olefins (suitably obtained by catalytic treatment of ethylene). The nature of an individual PAO depends in part on the carbon chain length of the original alpha-olefin, and also on the structure of the oligomer. The exact molecular structure may vary to some extent according to the precise conditions of the oligomerization, which is reflected in changes in the physical properties of the final PAO. Since the suitability of a particular PAO is determined primarily by its physical properties, and in particular its viscosity, the various products are generally differentiated and defined by their viscosity characteristics. Preferred for use in the compositions of the present invention are poly-α-olefins having a viscosity (measured at 100° C.) in the range of from 2 to 20 centistokes. More preferably, the poly-α-olefin has a viscosity of at least 8 centistokes, and most preferably about 10 centistokes at 100° C. The volatility of the poly-α-olefin is also of significance and may be determined by the Volatility Determination Method described below.

To determine the volatility of a substance the following Volatility Determination Method is used. The substance, e.g., a poly-α-olefin (110–135 grams) is placed in a three-neck, 250 mL round-bottomed flask having a threaded port for a thermometer. Such a flask is available from Ace Glass (Catalog No. 6954-72 with 20/40 fittings). Through the center nozzle of the flask is inserted a stirrer rod having a Teflon blade, 19 mm wide×60 mm long (Ace Glass catalog No. 8085-07). The substance (e.g., poly-α-olefin) is heated in an oil bath to 300° C. for 1 hour while stirring the substance in the flask at a rate of 150 rpm. During the heating and stirring, the free space above the substance in the flask is swept with 7.5 L/hr of inert gas (e.g., nitrogen, argon, etc.). The volatility of the substance poly-α-olefin thus determined is expressed in terms of the weight percent of material lost based on the total initial weight of material tested. Utilizing the foregoing procedure, it is particularly preferred to select poly-α-olefins for use in the additive formulations of this invention that have a volatility of less than about 50%, more preferably less than about 25%.

Another type of hydrocarbon that can be used is a relatively light mineral oil, e.g., a paraffinic, naphthenic or mixed base mineral oil. Preferred are mineral oils, most preferably naphthenic mineral oils, that have a viscosity in the range of about 10 to about 13 cSt at 100° C. and a volatility determined as above of less than about 50%, more preferably less than about 25%.

Still another type of hydrocarbon that may be included if desired are liquid polymers of lower hydrocarbons such as liquid polypropylene, polyisobutylene or ethylene-1-olefin copolymers.

While not required for the purposes of this invention, it is preferred that the fuel compositions of this invention include other additives such as one or more antioxidants, demulsifiers, and/or corrosion inhibitors. Accordingly, such optional, but preferred, components for use in the formulations of this invention will now be described.

Antioxidant.

Various compounds known for use as oxidation inhibitors can be utilized in the practice of this invention. These include phenolic antioxidants, amine antioxidants, sulfurized phenolic compounds, and organic phosphites, among others. For best results, the antioxidant should be composed predominantly or entirely of either (1) a hindered phenol antioxidant such as 2-tert-butylphenol, 2,6-di-tert-butylphenol, 2,4,6-tri-tert-butylphenol, 4-methyl- 2,6-di-tert-butylphenol, 4,4'-methylenebis(2,6-di-tert-butylphenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more such amine antioxidants. Particularly preferred for use in the practice of this invention are tertiary butyl phenols, such as 2,6-di-tert-butylphenol, 2,4,6-tri-tert-butylphenol, o-tert-butylphenol, and mixtures thereof.

Demulsifier.

A wide variety of demulsifiers are available for use in the practice of this invention, including, for example, polyoxyalkylene glycols, oxyalkylated phenolic resins, and like materials. Particularly preferred are mixtures of, polyoxyalkylene glycols and oxyalkylated alkylphenolic resins, such as are available commercially from Petrolite Corporation under the TOLAD trademark. One such proprietary product, identified as TOLAD 9308, is understood to be a mixture of these components dissolved in a solvent composed of heavy aromatic naphtha and isopropanol. This product has been found efficacious for use in the compositions of this invention. However, other known demulsifiers can be used such as TOLAD 286.

Corrosion Inhibitor.

Here again, a variety of materials are available for use as corrosion inhibitors in the practice of this invention. Thus, use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Henkel Corporation. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Also useful are the aminosuccinic acids or derivatives thereof represented by the formula:

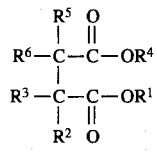

wherein each of $R^2$, $R^3$, $R^5$ and $R^6$ is, independently, a hydrogen atom or a hydrocarbyl group containing 1 to 30 carbon atoms, and wherein each of $R^1$ and $R^4$ is, independently, a hydrogen atom, a hydrocarbyl group containing 1 to 30 carbon atoms, or an acyl group containing from 1 to 30 carbon atoms.

The groups $R^1$, $R^2$, $R^3$, $R^4$, $R^5$ and $R^6$ when in the form of hydrocarbyl groups, can be, for example, alkyl, cycloalkyl or aromatic containing groups. Preferably $R^1$, $R^2$, $R^3$, $R^4$ and $R^5$ are hydrogen or the same or different straight-chain or branched-chain hydrocarbon radicals containing 1–20 carbon atoms. Most preferably, $R^1$, $R^2$, $R^3$, $R^4$ and $R^5$ are hydrogen atoms. $R^6$ when in the form of a hydrocarbyl group is preferably a straight-chain or branched-chain saturated hydrocarbon radical.

Most preferred is a tetralkenyl succinic acid of the above formula wherein $R^1$, $R^2$, $R^3$, $R^4$ and $R^5$ are hydrogen and $R^6$ is a tetrapropenyl group.

Base Fuels.

The above additive compositions of this invention are preferably employed in hydrocarbon mixtures in the gasoline boiling range or hydrocarbon/oxygenate mixtures, or oxygenates, but are also suitable for use in middle distillate fuels, notably, diesel fuels and fuels for gas turbine engines. The nature of such fuels is so well known to those skilled in the art as to require no further comment. By oxygenates is meant alkanols and ethers such as methanol, ethanol, propanol, methyl-tert-butyl ether, ethyl-tert-butyl ether, tert-amyl-methyl ether and the like, or combinations thereof. It will of course be understood that the base fuels may contain other commonly used ingredients such as cold starting aids, dyes, metal deactivators, lubricity additives, octane improvers, cetane improvers, emission control additives, antioxidants, metallic combustion improvers, and the like. Cyclopentadienyl manganese tricarbonyl compounds such as methylcyclopentadienyl manganese tricarbonyl are preferred because of their outstanding ability to reduce tailpipe emissions such as NOX and smog forming precursors and to significantly improve the octane quality of gasolines, both of the conventional variety and of the newer "reformulated" types. Oxygenates, when used, will normally be present in the base fuel in an amount below about 25% by volume, and preferably in an amount that provides an oxygen content in the overall fuel in the range of about 0.5 to about 5 percent by volume.

Proportions.

As noted above, on an active ingredient basis the proportions of a) to b) to c) in the compositions of this invention are such that per part by weight of c) there are from about 0.2 to about 5 parts by weight of a), and from about 0.2 to about 5 parts by weight of b). Preferably per part by weight of c) there are from about 0.5 to about 3 parts by weight of a) and from about 0.7 to about 2 parts by weight of b). More preferably per part by weight of c) there are from about 0.7 to about 2 parts by weight of a) and from about 0.7 to about 2 parts by weight of b).

When formulating the fuel compositions of this invention, the additives are employed in amounts sufficient to reduce or inhibit deposit formation on intake valves. Deposits on fuel injectors may also be reduced or at least controlled. Generally speaking, the finished additized fuel will contain, by weight on an active ingredient basis, no more than (and usually less than) about 3000 parts of the combination of components a) , b) and c) per million parts of the overall gasoline fuel composition, and preferably, up to (and more preferably less than) about 1500 parts of the combination of components a), b) and c) per million parts of the overall gasoline fuel composition. Additive concentrates of this invention will typically be employed in unleaded gasoline base fuels (which may or may not contain one or more oxygenated blending agents) in minor amounts such that the base fuel is the major component, i.e., over 50% by weight, and usually over 80% by weight.

Additive concentrates that further comprise, per 100 parts by weight of the concentrate, about 1 to about 5 parts by weight of gasoline-soluble antioxidant, about 0.1 to about 3 parts by weight of gasoline-soluble demulsifier, and about 0.025 to 1.0 part by weight of gasoline-soluble corrosion inhibitor (all parts on an active ingredient basis).

Table 1 sets forth general and preferred weight percentages (active ingredient basis) of the various components in the additive concentrates of this invention, "Component d)" being the total of any or all of the various types of hydrocarbons described above irrespective of source, and "Other" being other types of solvents, diluents or carriers (esters, ethers, etc.) present in the concentrate, and/or other conventional additives that may be included in the concentrate, such as an antiknock agent, dye, supplemental detergent or other additives.

TABLE 1

| Component | General Range, wt % | Preferred Range, wt % |
|---|---|---|
| a) | 5 to 60 | 20 to 40 |
| b) | 5 to 60 | 20 to 40 |
| c) | 3 to 40 | 15 to 30 |
| d) | 0 to 50 | 5 to 20 |
| Antioxidant | 0 to 5 | 0.2 to 2 |
| Demulsifier | 0 to 5 | 0.2 to 2 |
| Corrosion inhibitor | 0 to 5 | 0.2 to 2 |
| Other | 0 to 50 | 15 to 35 |
| Total | 100 | 100 |

Table 2 sets forth in terms of parts per million (by weight) the general and preferred amounts of the various components (active ingredient basis) in the fuel compositions of this invention, "Component d)" and "Other" having the same meanings as in Table 1. It will be appreciated that the additive components used in forming such fuels may be blended into the base fuel individually and/or in various sub-combinations. However it is preferably to blend into the base fuel an additive concentrate of this invention as this simplifies the blending operation, minimizes the possibility of blending errors, and takes advantage of the mutual compatibility characteristics of the concentrates.

TABLE 2

| Component | General Range, ppm | Preferred Range, ppm |
|---|---|---|
| a) | 5 to 600 | 20 to 400 |
| b) | 5 to 600 | 20 to 400 |
| c) | 3 to 400 | 15 to 300 |
| d) | 0 to 500 | 5 to 200 |
| Antioxidant | 0 to 50 | 2 to 20 |
| Demulsifier | 0 to 50 | 2 to 20 |
| Corrosion inhibitor | 0 to 50 | 2 to 20 |
| Other | 0 to 500 | 15 to 350 |

In order to illustrate the advantages of this invention, the following example is given.

EXAMPLE

The exceptional deposit control performance achievable by the practice of this invention was demonstrated by actual engine tests. For each run, a 1993 Ford Ranger truck equipped with a 2.3L engine was operated for 5,000 miles on a mileage accumulation dynamometer and the amounts and thicknesses of various engine deposits were determined. The engine was operated on a driving cycle representative of about 20% city, about 20% suburban and about 60% highway driving. Average speed was equivalent to about 41 miles per hour. Before each test was begun, the intake manifold and cylinder head were cleaned and inspected, the fuel injectors were checked for proper flow and spray pattern. Following each cleaning and inspection, the engine was rebuilt with new intake valves and the crankcase oil was changed. The base fuel was a clear (i.e., unadditized) regular unleaded gasoline. The crankcase oil used in the test runs was an SAE 5W-30 SG API-quality oil recommended by Ford Motor Company.

In these engine tests comparisons were made between a fuel of this invention which contained a Mannich base dispersant, a carbamate detergent and a poly(oxyalkylene) compound, and an identical fuel composition except that it did not contain the poly(oxyalkylene) compound. The tests were conducted in the same vehicle operated in the same manner. Thus these tests directly compared the performance of a composition of this invention comprising components a), b) and c) and an identical fuel not of this invention containing components a) and b), but not c). Component a) was the reaction product of (i) a 900 number average molecular weight polypropyl-substituted phenol, (ii) formalin, and (iii) diethylene triamine (a Mannich base detergent commercially available from Ethyl Petroleum Additives, Inc. as HiTEC® 4956 additive. ) The carbamate detergent was OGA 480 (Chevron Chemical Company, Oronite Division) used as received. Component c) was EMKAROX AF22 (ICI Chemicals and Polymers Ltd. ), apparently a poly(oxypropylene) monool with a molecular weight of about 1700 with a viscosity typically in the range of about 87 to about 98 cSt at 40° C. and typically in the range of about 15 cSt at 100° C. The sample used had a viscosity of 96 cSt at 40° C. and 17 cSt at 100° C.

Each additive mixture also contained Super High Flash Naphtha, a liquid hydrocarbon product having a flash point of about 40° C. (about 100° F.) and consisting of essentially 100% of aromatic hydrocarbons. The additives were formulated into additive concentrates. In the concentrate of this invention the weight ratio (using weights on an as received basis) of component a): component b): component c): aromatic hydrocarbon diluent was 82:65:26:42. Thus components a), b) and c) were used in a weight ratio of 3.15:2.5:1 on an as received basis, and 1.26:1.25:1 on a active ingredient basis. In the concentrate not of this invention the weight ratio (using weights on an as received basis) of component a): component b): aromatic hydrocarbon diluent was 82:65:68. Therefore in the comparative composition, components a) and b) were present in a weight ratio of 3.15:2.5 on an as received basis, and 1:1 on a active ingredient basis. The additive concentrates were then blended into separate quantities of the same base fuel at the level of 215 pounds per thousand barrels (ptb) which is equivalent to about 800 ppm (wt), and the resultant fuel compositions were then evaluated in the above engine test. The fuel of this invention contained (as received basis) 82 ptb of component a), 65 ptb of component b), 26 ptb of component c) and 42 ptb of aromatic hydrocarbon diluent. The fuel not of this invention contained (as received basis) 82 ptb of component a), 65 ptb of component b) and 68 ptb of aromatic hydrocarbon diluent.

The oil consumption was the same in both tests (8 fluid ounces in 5000 miles).

The deposit control performance of these respective compositions is summarized in Table 3 in which "IVD" is intake valve deposits, "CHD" is cylinder head deposits, "PTD" is piston top deposits, "ACHDT" is average cylinder head deposit thickness, and "APTDT" is average piston top deposit thickness.

TABLE 3

| Measurement | Fuel Of The Invention | Comparative Fuel |
|---|---|---|
| IVD, mg | 27.6 | 71.8 |
| CHD, mg | 845.5 | 952.8 |
| PTD, mg | 721.0 | 842.6 |
| ACHDT, mm | 0.1001 | 0.1128 |
| APTDT, mm | 0.0795 | 0.0860 |

It will be seen from Table 3 that the fuel of this invention exhibited reductions of 61.6% in IVD, 11.3% in CHD, 14.4% in PTD, 11.3% in ACHDT, and 7.6% in APTDT.

As used herein the term "fuel soluble" means that the additive under discussion has sufficient solubility in the particular gasoline fuel composition in which it is being used to dissolve at 20° C. to the extent of at least the minimum concentration required to achieve control of intake valve deposits in an internal combustion engine operated on the resulting fuel. Preferably, and in almost all cases, the additive should (and will) have a substantially greater gasoline solubility than this. However, the term does not require that the additive be soluble in all proportions in the gasoline fuel composition.

Each and every U.S. Patent referred to hereinabove is incorporated herein by reference as it fully set forth in this specification.

Variations in the invention as set forth in the foregoing description and examples are considered to be within the spirit and scope of the appended claims.

What is claimed is:

1. A fuel additive composition which comprises:

a) a gasoline-soluble Mannich reaction product of (i) a high molecular weight alkyl-substituted phenol, (ii) amine, and (iii) aldehyde;

b) a gasoline-soluble poly(oxyalkylene) carbamate; and c) a gasoline-soluble poly(oxyalkylene) alcohol, glycol or polyol, or mono or diether thereof.

2. A composition in accordance with claim 1 wherein the alkyl group of the Mannich reaction product has a number average molecular weight of from about 600 to about 3000, and wherein the poly(oxyalkylene) alcohol, glycol or polyol, or mono or diether thereof has a viscosity in its undiluted state of at least about 70 cSt at 40° C. and at least about 13 cSt at 100° C.

3. A composition in accordance with claim 1 wherein the proportions of a) to b) to c) are such that there are from about 0.2 to about 5 parts by weight of active Mannich base in a) and from about 0.2 to about 5 parts by weight of active carbamate detergent in b) per part by weight of c).

4. A composition in accordance with claim 1 wherein the alkyl group of the Mannich reaction product has a number average molecular weight within the range of from about 800 to about 1200.

5. A composition in accordance with claim 1 wherein the amine is a polyalkylene amine selected from diethylene triamine and triethylene tetramine or mixtures thereof.

6. A composition in accordance with claim 1 wherein c) thereof is a monoether derivative of polyoxyalkylene glycol.

7. A composition in accordance with claim 6 wherein the amine of a) is a polyamine, the aldehyde of a) is formaldehyde or a formaldehyde precursor, and said monoether derivative of polyoxyalkylene glycol has a viscosity in the range of about 87 to about 98 cSt at 40° C. and in the range of about 15 to about 19 cSt at 100° C., and an average molecular weight of about 1700.

8. A composition in accordance with claim 1 wherein the proportions of a) to b) to c) are such that there are from about 0.5 to about 3 parts by weight of active Mannich base in a) and from about 0.5 to about 3 parts by weight of active carbamate detergent in b) per part by weight of c).

9. A composition in accordance with claim 1 wherein the amine of a) is a polyamine, the aldehyde of a) is formaldehyde or a formaldehyde precursor, and said monoether derivative of polyoxyalkylene glycol has a viscosity in the range of about 87 to about 98 cSt at 40° C. and in the range of about 15 to about 19 cSt at 100° C., and an average molecular weight of about 1700; wherein c) is a monoether derivative of polyoxyalkylene glycol; and wherein the proportions of a) to b) to c) are such that there are from about 0.7 to about 2 parts by weight of active Mannich base in a) and from about 0.7 to about 2 parts by weight of active carbamate detergent in b) per part by weight of c).

10. A composition in accordance with claim 1 wherein the poly(oxyalkylene) alcohol, glycol or polyol, or mono or diether thereof has a viscosity in its undiluted state of at least about 70 cSt at 40° C. and at least about 13 cSt at 100° C. and wherein said composition further comprises one or more organic liquid diluents collectively having viscosities at 40° C. and 100° C. that are no higher than about 25% of the respective viscosities of said polyoxyalkylene compound at 40° C. and 100° C.

11. A composition in accordance with claim 10 wherein said diluents comprise an aromatic hydrocarbon component that has a boiling point or a final boiling point no higher than about 240° C.

12. A composition in accordance with claim 10 wherein said diluents comprise an aromatic hydrocarbon component that in its undiluted state boils in the range of about 160° to about 300° C. and has a viscosity in the range of about 1.4 to about 2.0 cSt at 25° C.

13. A composition in accordance with claim 11 wherein said diluents further comprise polyolefin polymer having a number average molecular weight of from about 800 to about 1200.

14. A composition in accordance with claim 10 further comprising, per 100 parts by weight of said composition, about 1 to about 5 parts by weight of gasoline-soluble antioxidant, about 0.1 to about 3 parts by weight of gasoline-soluble demulsifier, and about 0.025 to 1.0 part by weight of gasoline-soluble corrosion inhibitor.

15. A composition which comprises a major amount of hydrocarbons of the gasoline boiling range and a minor engine deposit-inhibiting amount of a fuel additive composition in accordance with claim 1.

16. A composition which comprises a major amount of hydrocarbons of the gasoline boiling range and a minor engine deposit-inhibiting amount of a fuel additive composition in accordance with claim 2.

17. A composition which comprises a major amount of hydrocarbons of the gasoline boiling range and a minor engine deposit-inhibiting amount of a fuel additive composition in accordance with claim 3.

18. A composition which comprises a major amount of hydrocarbons of the gasoline boiling range and a minor engine deposit-inhibiting amount of a fuel additive composition in accordance with claim 4.

19. A composition which comprises a major amount of hydrocarbons of the gasoline boiling range and a minor engine deposit-inhibiting amount of a fuel additive composition in accordance with claim 5.

20. A composition which comprises a major amount of hydrocarbons of the gasoline boiling range and a minor engine deposit-inhibiting amount of a fuel additive composition in accordance with claim 6.

21. A composition which comprises a major amount of hydrocarbons of the gasoline boiling range and a minor engine deposit-inhibiting amount of a fuel additive composition in accordance with claim 7.

22. A composition which comprises a major amount of hydrocarbons of the gasoline boiling range and a minor engine deposit-inhibiting amount of a fuel additive composition in accordance with claim 8.

23. A composition which comprises a major amount of hydrocarbons of the gasoline boiling range and a minor engine deposit-inhibiting amount of a fuel additive composition in accordance with claim 9.

24. A composition which comprises a major amount of hydrocarbons of the gasoline boiling range and a minor engine deposit-inhibiting amount of a fuel additive composition in accordance with claim 10.

25. A composition which comprises a major amount of hydrocarbons of the gasoline boiling range and a minor engine deposit-inhibiting amount of a fuel additive composition in accordance with claim 11.

26. A composition which comprises a major amount of hydrocarbons of the gasoline boiling range and a minor engine deposit-inhibiting amount of a fuel additive composition in accordance with claim 12.

27. A composition which comprises a major amount of hydrocarbons of the gasoline boiling range and a minor engine deposit-inhibiting amount of a fuel additive composition in accordance with claim 13.

28. A composition which comprises a major amount of hydrocarbons of the gasoline boiling range and a minor engine deposit-inhibiting amount of a fuel additive composition in accordance with claim 14.

29. A method for controlling intake valve deposits in a gasoline engine comprising fueling and operating said engine with a fuel composition which comprises a major amount of hydrocarbons of the gasoline boiling range and a minor engine deposit-inhibiting amount of a fuel additive composition which comprises:

a) a gasoline-soluble Mannich reaction product of (i) a high molecular weight alkyl-substituted phenol, (ii) amine, and (iii) aldehyde;

b) a gasoline-soluble poly(oxyalkylene) carbamate; and c) a gasoline-soluble poly(oxyalkylene) alcohol, glycol or polyol, or mono or diether thereof.

30. A method in accordance with claim 29 wherein the poly(oxyalkylene) alcohol, glycol or polyol, or mono or diether thereof has a viscosity in its undiluted state of at least about 70 cSt at 40° C. and at least about 13 cSt at 100° C., and wherein said fuel composition further comprises:

d) one or more liquid hydrocarbon diluents collectively having viscosities at 40° C. and 100° C. that are no higher than about 25% of the respective viscosities of said polyoxyalkylene compound at 40° C. and 100° C.

31. A method in accordance with claim 30 wherein said fuel composition contains on an active ingredient basis, about 20 to about 40 parts per million by weight of a), about 20 to about 40 parts per million by weight of b), about 15 to about 30 parts per million by weight of c), and about 5 to about 200 parts per million by weight of d); and wherein said fuel composition further comprises about 2 to about 20 parts per million by weight of gasoline-soluble antioxidant, about 2 to about 20 parts per million by weight of gasoline-soluble demulsifier, and about 2 to about 20 parts per million by weight of gasoline-soluble corrosion inhibitor.

32. A fuel composition for use in operating a gasoline engine therewith, which fuel composition comprises a major amount of hydrocarbons of the gasoline boiling range with which has been blended minor engine-deposit controlling amounts of:

a) a gasoline-soluble Mannich reaction product of (i) at least one high molecular weight alkyl-substituted phenol, (ii) at least one polyamine, and (iii) at least one aldehyde;

b) a gasoline-soluble poly(oxyalkylene) carbamate; and c) a gasoline-soluble poly(oxyalkylene) alcohol, glycol or polyol, or mono or diether thereof that has in its undiluted state a viscosity in the range of about 87 to about 98 cSt at 40° C. and in the range of about 15 to about 19 cSt at 100° C.

in proportions of from about 0.5 to about 3 parts by weight of active Mannich base in a) and from about 0.5 to about 3 parts by weight of active carbamate detergent in b) per part by weight of c).

33. A composition of claim 32 wherein c) is a poly(oxyalkylene) monool with an average molecular weight of about 1700.

34. A composition of claim 32 wherein said a), b) and c) are blended into said hydrocarbons of the gasoline boiling range as a fuel additive mixture comprising at least said a), b) and c) in said proportions.

35. A method of controlling the total weight of deposits formed on the intake valves, on the underside of the cylinder head and on the tops of the pistons of a gasoline engine which comprises fueling said engine with and operating said engine on a fuel composition as claimed in claim 32.

* * * * *